United States Patent [19]

Sabatka et al.

[11] 4,326,933

[45] Apr. 27, 1982

[54] ELECTRO-CHEMICAL DEBURRING METHOD

[75] Inventors: Winston E. Sabatka, Lakeville; Wilburn M. Bloomquist, Bloomington, both of Minn.

[73] Assignee: Finishing Equipment, Inc., St. Paul, Minn.

[21] Appl. No.: 37,297

[22] Filed: May 9, 1979

Related U.S. Application Data

[63] Continuation-in-part of Ser. No. 896,465, Apr. 14, 1978, abandoned.

[51] Int. Cl.[3] ..... C25F 3/02; C25F 3/14

[52] U.S. Cl. ..... 204/129.6; 204/129.65; 204/206

[58] Field of Search ..... 204/129.6, 129.65, 129.7

[56] References Cited

U.S. PATENT DOCUMENTS

| | | | |
|---|---|---|---|
| 2,307,928 | 1/1943 | Hogaboom | 204/206 |
| 2,395,437 | 2/1946 | Venable | 204/206 |
| 2,490,055 | 12/1949 | Hoff | 204/206 |
| 2,569,577 | 10/1951 | Reading | 204/206 |
| 2,569,578 | 10/1951 | Rieger | 204/206 |
| 2,762,763 | 9/1956 | Kenmore | 204/206 |

*Primary Examiner*—T. M. Tufariello
*Attorney, Agent, or Firm*—Kinney, Lange, Braddock, Westman & Fairbairn

[57] ABSTRACT

Flat metallic varnish-coated metal stampings or laminations to be deburred are conveyed by contiguous vertically aligned pairs of horizontal rollers across the top of a plurality of deburring cells or vats which are continuously overflowing with an electrolyte. Alternate cells are equipped with positively and negatively charged electrodes. The electrolyte is continuously supplied to each of the cells at a rate such that the electrolyte overflows the lips of each cell over which the lamination approaches and retreats from the cell. In this manner, the top surface of the electrolyte is maintained above the top surface of the lamination so that the electrolyte inundates at least the burrs on the edges of the lamination. Current flow from each positive electrode through the electrolyte, the stamped burred edges of the laminations and to the negative electrode causing the burrs on the laminations to be removed by anodic action. Flat metallic sheets selectively partially coated with thin films of impervious material are similarly processed to etch or chemically mill the uncoated portions thereof.

2 Claims, 5 Drawing Figures

ELECTRO-CHEMICAL DEBURRING METHOD

This application is a continuation-in-part of our copending application Ser. No. 896,465, filed Apr. 14, 1978, now abandoned.

BACKGROUND OF THE INVENTION

In order to debur flat, varnish coated metallic stampings or laminate, it has been suggested to convey those stampings horizontally using vertically aligned pairs of horizontally normally contiguous rollers. In theory, a structure was devised whereby the laminations would pass between a plurality of pairs of parallel, closedly spaced, similarly charged electrodes, alternate pairs of electrodes being charged positively and negatively. Electrolyte was to flow between each pair of electrodes flooding the volume between the electrodes and the lamination or stamping passing therebetween. Pairs of conveyor rollers were to be situated between each set of electrodes.

The plan called for the addition of electrolyte both above and below one set of conveyor rollers with the electrolyte supposedly leaving the cell both above and below the next adjacent vertical roller set.

This structure was found to be unsatisfactory, and the structure of the present invention was developed to overcome its deficiencies.

In the parent application, the following prior art patents were cited:

- U.S. Pat. No. 2,307,928 granted to Hogaboom in January of 1943;
- U.S. Pat. No. 2,395,437 granted to Venable in February of 1946;
- U.S. Pat. No. 2,490,055 granted to Hoff in December of 1949;
- U.S. Pat. No. 2,569,577 granted to Reading in October of 1951;
- U.S. Pat. No. 2,569,578 granted to Rieger in October of 1951; and
- U.S. Pat. No. 2,762,763 granted to Kenmore et al in September of 1956.

Neither applicants nor those in privity with them know of any closer prior art than that cited above. Neither applicants nor those in privity with them know of no prior art which anticipates the claims set out herein.

BRIEF SUMMARY OF THE INVENTION

In order to remove burrs formed during the production of metallic stampings or laminations from sheets of metal, each lamination is conveyed through a first pair of vertically aligned, normally contiguous, driven horizontal conveyor rollers and into and through successive pairs of such driven, conveyor rollers to maintain it in a horizontal plane. Between each pair of such rollers, the laminations pass over the top of a cell or vat which is filled to overflowing with an electrolyte. Alternate cells are charged positively and negatively by alternate positive and negative electrodes situated therein.

Each of the cells or vats is situated above a sump, and a conduit connects a pump in the sump to each of the cells above it to cause the electrolyte to flow into the cell and over the top of the cell and back into the sump.

The relationship to the plane in which the laminations are being conveyed above the top of the cells and of the rate of electrolyte flow into the cells is such that the upper surface of the electrolyte flowing out of the cells is higher than the top surface of the laminations moving across the top of the cells.

This causes portions of the lamination, and particularly the edge portions where the burrs have been formed, to be inundated by the electrolyte.

The current flow is from the positive electrodes, through the electrolyte in the positive cell or vat, and through the raw edges of the lamination including all burrs thereon, through the lamination and the raw edges thereof into the electrolyte of one or both of the adjoining negative cells or vats and to the negative electrodes in those cells, thus tending to remove the burrs on the lamination by electro-chemical action. In the vat with the positive electrode, hydrogen will form on the lamination and the electrode will dissolve away. In the vat with the negative electrode, the burrs on the lamination will dissolve away and hydrogen will form on the electrode.

In a typical application, the sheet metal from which the laminations are formed will have been covered on both sides with a varnish or other insulating layer before the stamping is done to form the lamination, so the current flow will tend to be concentrated at the raw edges thus formed including, of course, the burrs which are being removed.

The deburring is accomplished by continuously passing the laminations over the top of enough cells to remove the offending metal. The laminations, while still being passed horizontally by vertically aligned pairs of normally contiguous rollers, can then be put through a de-ionizing wash which can include the same kind of a overflowing vat augmented by a spray from the top if desired; or can consist of a spray from top and bottom.

Drying can be done by the use of high pressure air applied vertically from horizontal heads both above and below the laminations. The laminations will then emerge continuously from the apparatus in a deburred, de-ionized and dry state, ready for their ultimate intended use.

Chemical milling or etching can be achieved by applying the insulating layer only to those portions of the flat surface which are not to be etched or milled.

IN THE DRAWINGS

FIG. 1 is a side elevational view with parts in section and parts broken away of a portion of the apparatus of the invention;

DESCRIPTION OF PREFERRED EMBODIMENTS

An electro-chemical deburring apparatus 10 of the present invention includes a main frame 12 supported on adjustable feet 14. Legs 16 extend upwardly from these feet, and support two mutually parallel, longitudinally extending, channel-like, horizontal runners 18,18. These runners are connected at opposite ends of the frame 12 to each other by similar channel-like but transverse horizontal runners, (not specifically shown) and these runners all serve to support the cells and the conveying rollers of the apparatus.

Figure 2:
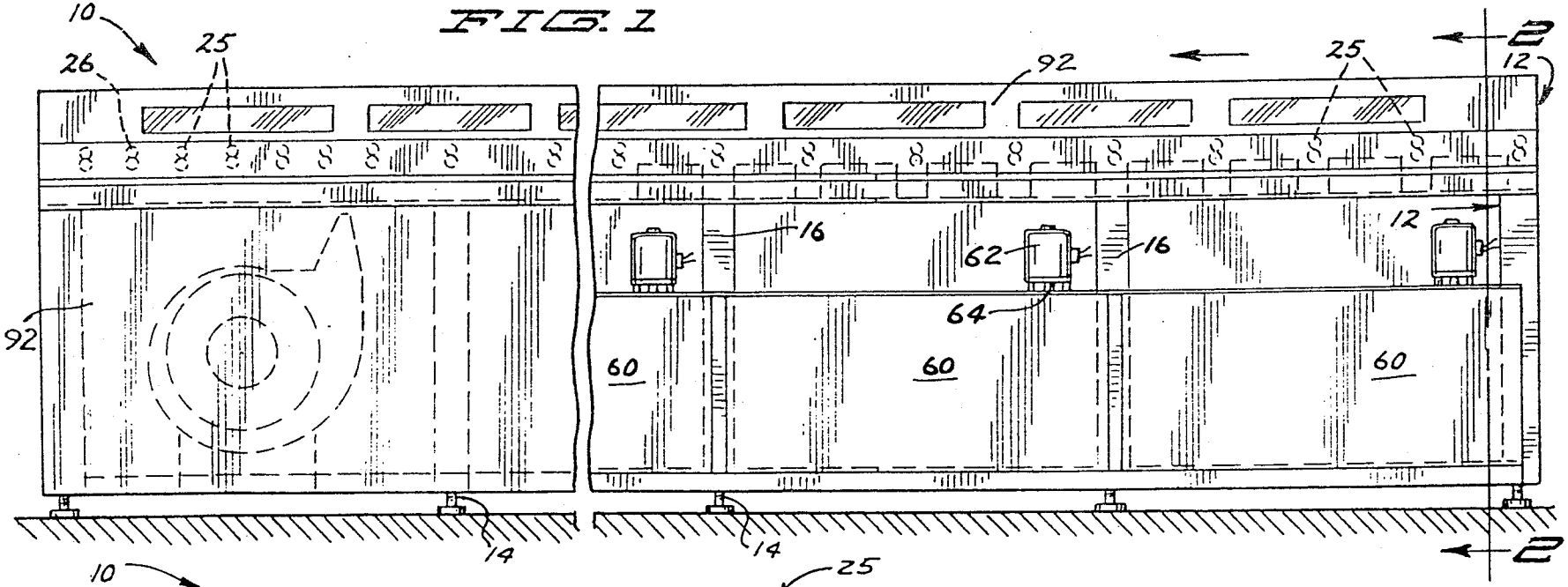
FIG. 2 is an enlarged vertical sectional view taken on the line 2—2 in FIG. 1.

Horizontally extending, vertically positioned, roller support plates 20,20 are supported on and extend upwardly from the longitudinally extending runers 18,18, and electrolyte splash plates 22,22 extend downwardly from the support plates 20 as best seen in FIG. 2, along the entire electro-chemical operative length of the apparatus.

Extending through these splast plates 22,22 and mounted, as by welding, for example, between opposite support plates 20,20 are parallel, spaced-apart electrolyte cell or vat support straps 24.

A plurality of pairs 26 or horizontally disposed, vertically aligned, upper conveying rollers 26 and lower conveying rollers 28 are mounted on upper axles 30 and lower axles 32 respectively to normally be in contiguous relation to each other. These axles extend through and are rotatably mounted with respect to each of the roller support plates 20,20. Each roller is made up of an outer cylindrical portion 34 of rubber or other electrically non-conducting material which is non-reactive to the electrolyte to be employed, over one of the already mentioned upper axles 30 or lower axles 32.

Drive means connects each upper roller and lower roller in such a manner that the normally contiguous surfaces of the two rollers will always move at the same speed and in the same direction at the point of contact. Also, each pair 25 of rollers will be driven at exactly the same speed and in the same direction as every other pair. This drive can be of any usual or preferred construction, but in the form of the invention as shown, and as best seen in FIG. 2, intermeshing gears 36,36 are each mounted to turn with one of the axles 30 or 32 on each pair of rollers to insure that the rollers drive at the same speed and rotate in opposite directions. Each lower axle 32 has a pair of drive sprockets 40,40 mounted thereon, and one of a pair of drive chains 42,42 extend from one of the sprockets 40 to the sprocket 40 on the next adjacent axle 32 in a first direction and the other drive chain 42 extends to the sprocket 40 on the next adjacent axle 32 in the second opposite direction.

A drive chain 44 extends over a driven sprocket 46 on an opposite end of any one of the lower axles 32. This drive chain 44 is powered by a motor (not shown) through an adjustable drive train (not shown) which can, in one form of the invention, vary the peripheral speed of the rollers 26 and 28 to from 20 ft. (6 meters) per minute to 70 ft. (21 meters) per minute.

Figure 5:
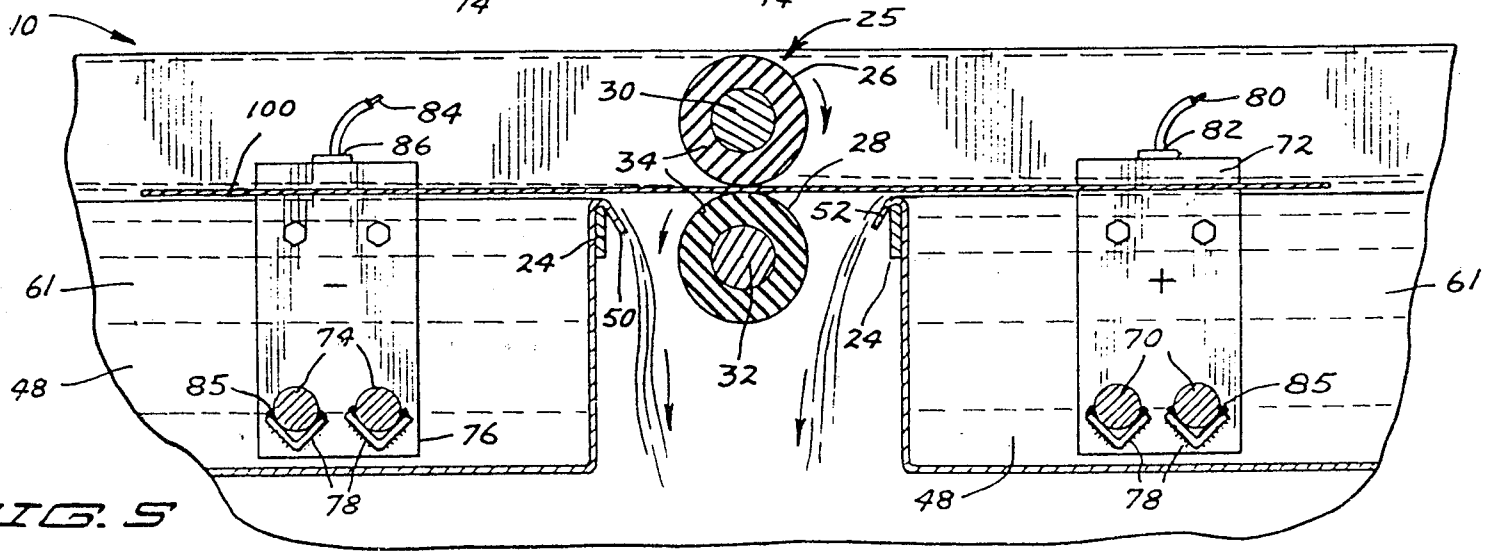
FIG. 5 is an enlarged fragmentary vertical sectional view taken on the line 5—5 in FIG. 2.
Figure 2:
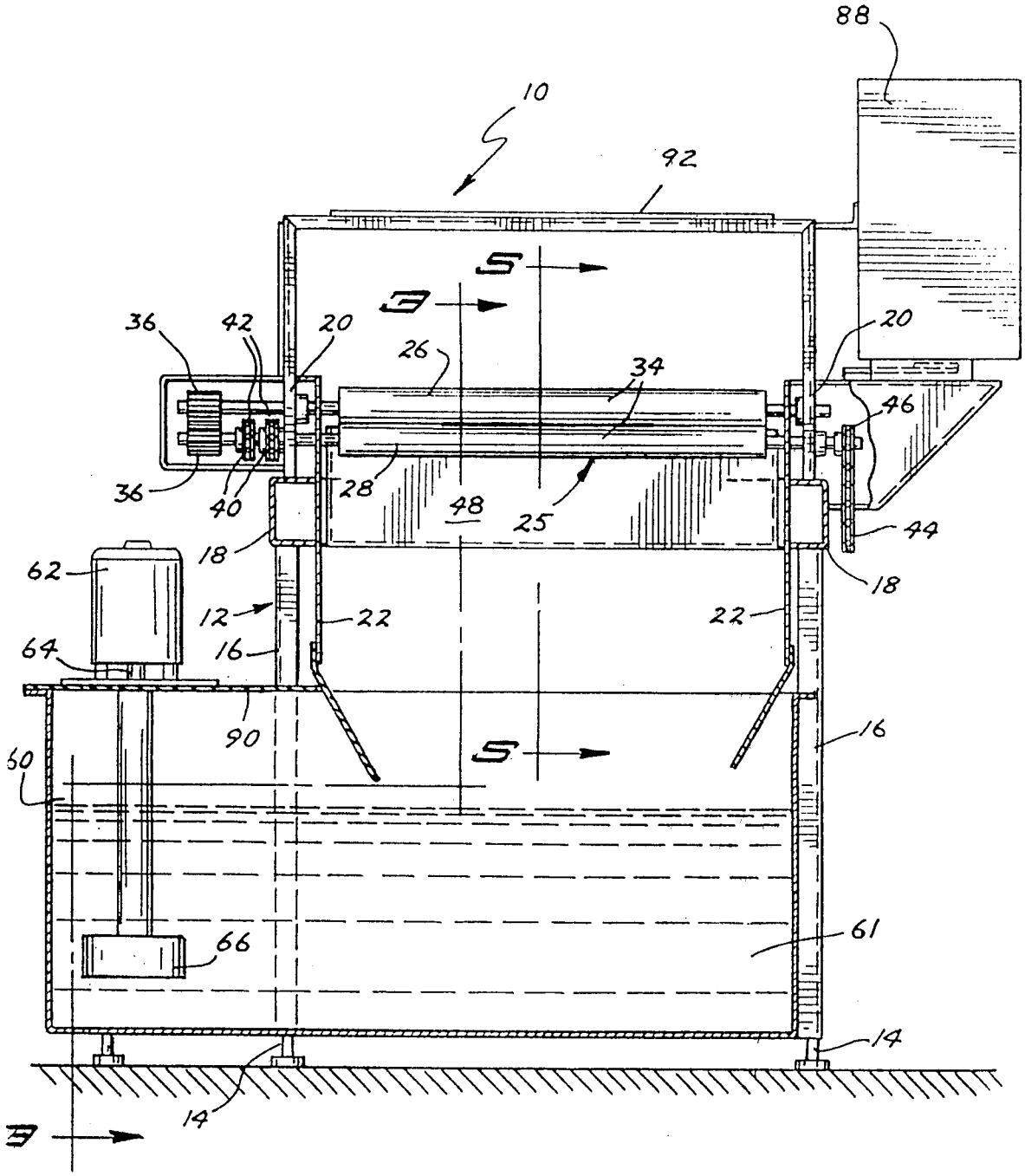

In the form of the invention as shown, there are a plurality of fiberglass electrolytic cells or vats 48 each having a leading edge lip 50 and a trailing edge lip 52 each supported on one of the parallel, spaced-apart electrolytic cell support straps 24, as perhaps best seen in FIG. 5. As shown, the lips 50 and 52 terminate at an upper horizontal edge which is just slightly below a plane passing through the point of contact between each upper roller 26 and its corresponding lower roller 28. In one form of the invention, the upper edges of the lips 50 and 52 has been situated $\frac{1}{8}$ of an inch (0.3175 mm) below this horizontal plane.

As shown, the side edges of the electrolytic cells or vats 48 are level with the top edges of the lips 50 and 52; but it is to be understood that these side edges could stand higher than the top edges of these lips and this would cause all of the overflow from the cell to go over one or the other of the lips.

A plurality of sumps or sump tanks 60 are each situated on the frame 12 to receive overflow from several of the cells 48. These tanks 60 contain a suitable electrolyte 61. The overflow of electrolyte 61 is directed into the sump tanks and prevented from splashing out from them by the electrolyte splash plates 22,22. In each sump tank, an electric motor 62 is connected by a motor drive shaft 64 to drive a submerged electrolyte pump 66 which is connected by a plurality of hoses or conduits 68 to supply electrolyte into the bottom of each of the cells 48 which overflow into that sump tank.

A plurality of pairs of positive electrodes 70 are positioned in every other one of the electrolytic cells 48 by metallic electrode hangers 72; while pairs of negative electrodes 74 are positioned in the remaining cells 48 by metallic electrode hangers 76.

Figure 4:
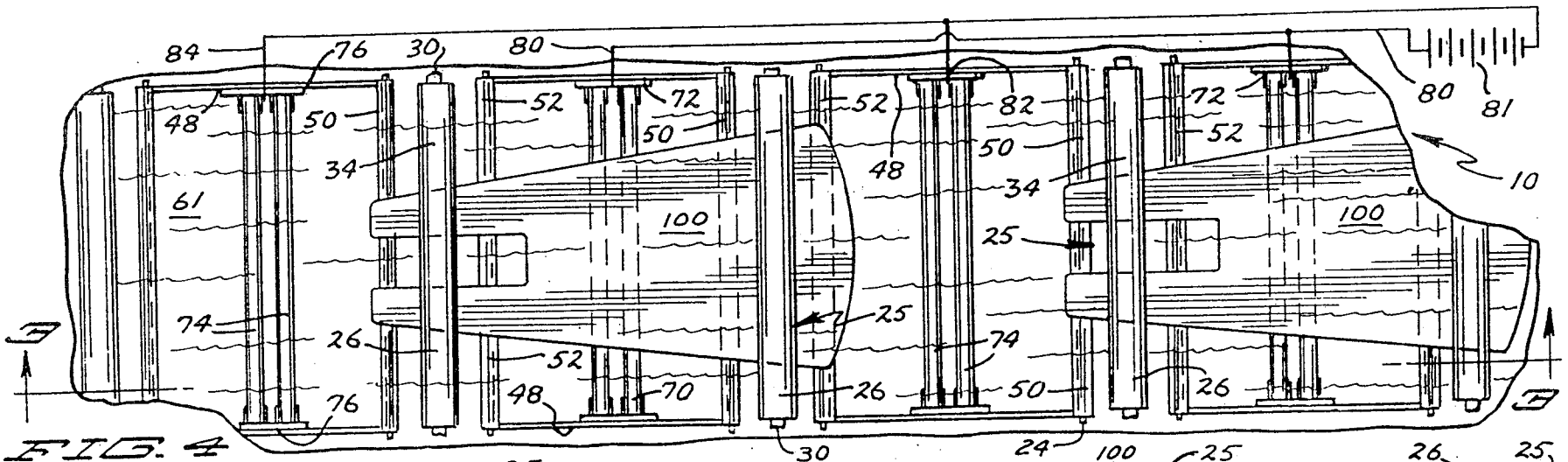
FIG. 4 is a fragmentary top plan view of some of the apparatus of the invention and also disclosing a schematic representation of the electrical circuitry interconnecting the electrodes in the cells of the invention.
Figure 3:
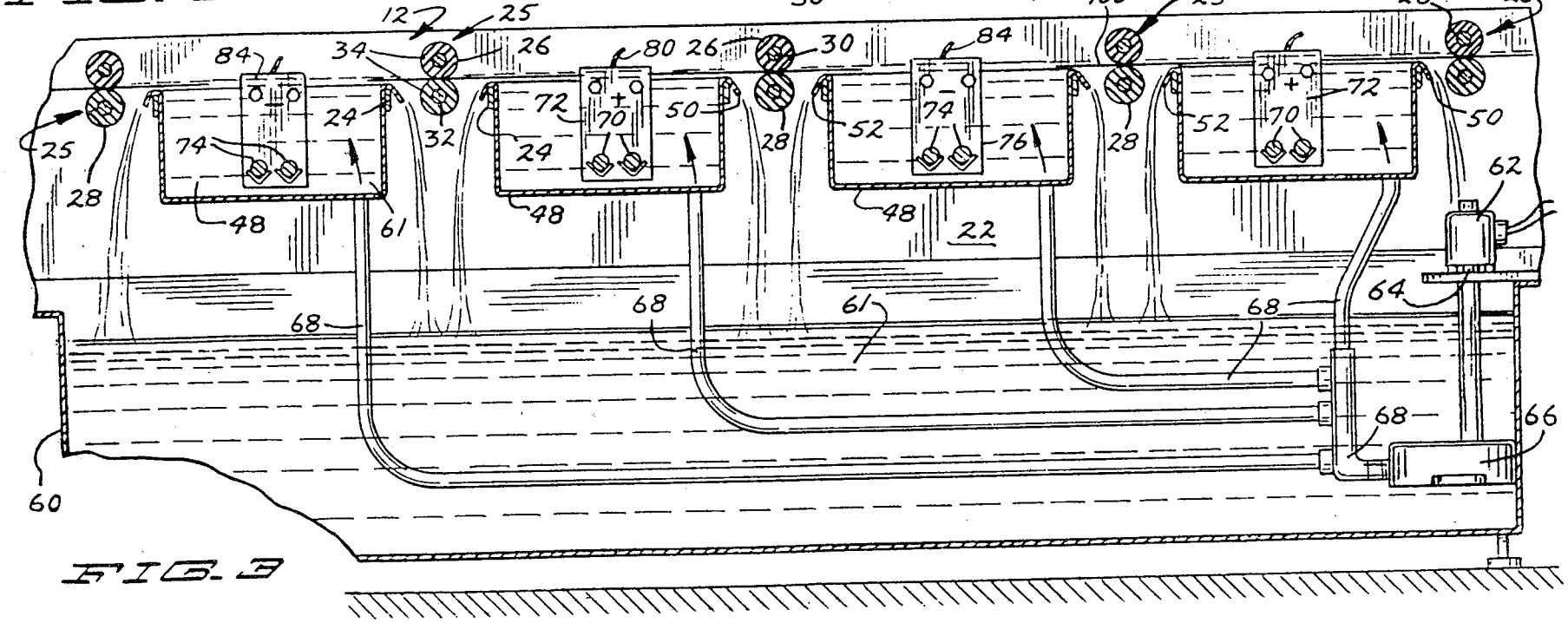
FIG. 3 is a fragmentary vertical sectional view taken on the line 3—3 in FIG. 2.

As best seen in FIG. 5, metallic electrode support clips 78,78 extend outwardly from each of the electrode hangers 72 and 76. An electrical cable 80 is fastened as by welding to each of the metallic electrode hangers 72 as at 82 along one side of the frame 12; while an electrical cable 84 is electrically connected as by welding to each metallic electrode hanger 76 as at 86 along the same side of the frame. As best seen in FIG. 4, the cables 80 all extend to a positive side of a source of direct current electromotive force 81 while the cables 84 extend to the negative side of this source, thus charging each of the electrodes 70 with a potential which is positive with respect to each of the negative electrodes 74.

The electrodes can be spot welded as at 85 to the clips 78 to insure good electrical contact.

In one form of the invention, a potential difference of 24 volts has been found to be satisfactory, where laminations or metal stampings 100 are made of lamination type steel and the electrolyte consists of a solution of sodium nitrate and water.

It has been found to be satisfactory to make the metallic electrodes to Type 316L Stainless Steel.

The frame 12 can be provided with stainless steel covers 90 which encompass the open top of the sump tanks 60, and vapor proof opaque or transparent covers 92 to enclose the electrolytic cells and the drive rollers and the work or laminations passing through the drive rollers. Various ventilation hoods such as that shown at 88 can be provided with relative ease due to the basic compact design of the structure of the invention.

OPERATION

To put the electro-chemical deburring apparatus 10 of the invention in condition to be operative, electric motors 62 will be activated to drive the electrolyte pumps 66 to cause each of the cells 48 to be filled with the electrolyte 61 and to cause this electrolyte to flow at least over the cells leading edge lips 50 and trailing edge lips 52 at a sufficient rate so that a flow height over these lips of approximately 0.125" (0.3175 mm) is established and maintained. The direct current electromotive force between the positive electrodes 70 and the negative electrodes 74 will be set up, and the drive of the conveying roller pairs 25 will be actuated.

Sheet metal stampings or other laminations 100 having protruding metallic burrs to be removed are fed into the right end of the apparatus 10 as seen in FIGS. 1, 3, 4 and 5 and the first of the roller pairs 25 will grip each lamination in turn and carry it into the second pair of rollers, with that pair feeding it to the third pair and so on down the line until each lamination 100 emerges from the apparatus.

For a lamination made of stainless steel and having outside dimensions of approximately 20" (50 mm) by 25" (64 mm), and having a thickness of from 0.014" (0.03556 mm) to 0.018" (0.04572 mm), something of the order of 3000 ampere seconds of power must be transferred through it; and the numbers of pairs of electrolytic cells, the rate of feed of laminations in feet (meters) per minute, the makeup of the electrolyte, and the potential difference between the positive and negative electrodes will be such as to achieve this result. This will result in the deplating of 0.7 to 0.8 grams of iron from each laminate.

Where chemical milling or etching of the laminations or other metallic sheets 100 is to be accomplished, and insulating layer of any suitable nature, for example varnish, is applied to those surfaces of the sheets which are not to be etched or milled. The action will be the same as described in connection with deburring.

The work pieces have been referred to herein as laminations or as sheet metal stampings, but any work piece having a substantially flat bottom could be processed. Further, an electro-chemical action is referred to herein, but the apparatus of the invention can be readily used for processing lower portions of other work pieces which for some reason cannot be dipped in the processing liquid. For example, with or without the electrolytic action, the apparatus can be used for etching burrs or other uncoated portions of a work piece having a horizontal bottom. Also for painting, degreasing, cleaning, etc.

The embodiments of the invention in which an exclusive property or privilege is claimed are defined as follows:

1. A method of removing burrs from flat sheet metal stampings including the steps of:

A. conveying a succession of spaced-apart horizontally disposed flat sheet metal stampings in a single horizontal plane between spaced pairs of vertially disposed horizontal rollers.

B. situating a vat having a horizontal top leading edge lip and a horizontal top trailing edge lip between each adjacent pair of rollers such that the lips are in line with and below the path of said stampings between the roller pairs, the space between adjacent vats being less than the linear dimension of the stampings in the direction the stampings are being conveyed.

C. providing an electrolyte bath for inundating at least the edges of said stampings while over said vats by delivering electrolyte to said vats at a rate such that the electrolyte overflows the vats and such that the uppermost surface of the electrolyte is maintained above the top surface of said stampings; and D. providing an electro-chemical anodic action to remove any burrs on the stampings by providing electrodes in each vat and providing an electromotive force to each electrode such that the electrodes in every second vat are charged negatively with respect to the electrodes in the adjacent vats.

2. A method of electro-chemically affecting by anodic action uninsulated portions of flat metallic sheets including the steps of:

A. conveying a succession of spaced-apart horizontally disposed flat metallic sheets having at least some insulated portions in a single horizontal plane between spaced pairs of vertically disposed horizontal rollers;

B. situating a vat having a horizontal top leading edge lip and a horizontal top trailing edge lip between each adjacent pair of rollers such that the lips are in line with and below the path of said sheets between the roller pairs, the space between adjacent vats being less than the linear dimension of the sheets in the direction the sheets are being conveyed;

C. providing an electrolyte bath for inundating at least the edges of said sheets while over said vats by delivering electrolyte to said vats at a rate such that the electrolyte overflows the vats and such that the uppermost surface of the electrolyte is maintained above the top surface of said metallic sheets; and D. providing an electro-chemical anodic action to remove metal from the uninsulated portions of said sheets by providing electrodes in each vat and providing an electromotive force to each electrode such that the electrodes in every second vat are charged negatively with respect to the electrodes in the adjacent vats.

* * * * *